US005449059A

United States Patent [19]

Wohlrab

[11] Patent Number: 5,449,059

[45] Date of Patent: Sep. 12, 1995

[54] COIN SWITCH FOR A COIN HANDLING DEVICE

[75] Inventor: Ekhart Wohlrab, Stade, Germany

[73] Assignee: National Rjectors Inc. GmbH, Buxtehude, Germany

[21] Appl. No.: 130,266

[22] Filed: Oct. 1, 1993

[30] Foreign Application Priority Data

Oct. 2, 1992 [DE] Germany ..... 42 33 193.5

[51] Int. Cl.[6] ..... G07F 1/04

[52] U.S. Cl. ..... 194/346; 335/281

[58] Field of Search ..... 194/346; 335/281; 379/152, 153

[56] References Cited

U.S. PATENT DOCUMENTS 4,582,189 4/1986 Schmitt ..... 194/346 X
4,838,406 6/1989 Levasseur ..... 194/346

FOREIGN PATENT DOCUMENTS

2915714A1 4/1981 Germany .
2064841A 6/1981 United Kingdom .

*Primary Examiner*—F. J. Bartuska
*Attorney, Agent, or Firm*—Vidas, Arrett & Steinkraus

[57] ABSTRACT

The invention refers to a coin switch for a coin handling device. According to the invention, the switching element is an individual member made of plastic material, the armature is provided with at least a lateral projection extending towards the magnet and the magnet includes a yoke portion extending parallel and in a small distance with respect to said projection.

19 Claims, 4 Drawing Sheets

COIN SWITCH FOR A COIN HANDLING DEVICE

The present invention relates to a coin switch for a coin handling device.

A coin handling device includes a coin checking means and at least a coin switch. The coin switch is required to guide a coin which has been inserted and after having been checked either to an accepting channel or a return channel. As modern coin handling devices are suitable to accept a variety of coins, a sorting means is further required which needs a number of coin switches.

Known coin switches comprise a plate element which is selectively linearly moved by an electromagnet into and out of the track of a coin. In the former case, the coin impacts against the plate element and will be deflected. Furthermore, coin switches are known operating with upright standing switch elements to guide incoming coins to different channels extending below. The coins are not subjected to an impact, but rather slide along an inclined surface of the switch element before entering the respective channel. The invention relates to a structure of the latter type.

GB 2 064 841 discloses a slide-like switch element provided with an integral armature which is slidably supported in a slot by means of bearing pins and is pivoted by a magnet such that the slide-like switch element releases a coin channel. DE-A-29 15 714 discloses alike a one-piece armature of a pivoting armature magnet which is rotatably supported about an axis.

As far as battery-operated coin checking means are concerned, the energy consumption should be low. The energy consumption of known switches is substantial. It is still further required to move the coin switches as rapidly as possible from the one position into the other and vice versa. This requirement is not suitably met by known devices.

SUMMARY OF THE INVENTION

An object of the invention is to provide a coin switch that is produced from a minimal number of movable parts, has small dimensions and requires less energy to be operated.

According to the invention, the flap-like armature and the switch element define a unit which is rotatably supported about a common axis of the coin handling device. The rotational axes of the switch element (sorting flap) and the armature are coaxial. It might be conceivable to make the switch element from metal as well. However, by reasons of weight and energy consumption, the switch element is individually made from plastic material. The armature comprises at least a lateral projection extending towards the magnet which has a yoke portion extending approximately parallel and in a short distance with respect to the projection. Thereby, a very small air gap is provided between the armature and the magnet resulting in an effective magnetic field. When the armature starts to move, a relatively high pulling force acts this way on the armature to highly reduce the total displacement time. Furthermore, the design of the mag-net and the armature requires less energy resulting in a magnet having a smaller power consumption for a predetermined pulling force.

By making the switch element from plastic material, the switch element may be made very light in weight. The small mass of the switch element requires a low actuating energy as well as a very short actuating time.

This is a particular advantage with battery-operated coin handling devices. Furthermore, making the switch element from plastic material facilitates its geometrical shape and attachment to the armature as the circumstances require.

According to a further aspect of the invention, the armature and the switching element extend under an angle towards each other. The armature and the switching element may be arranged at the same side or the opposite side of the pivotal axis. This depends on the available space where the coin switch is to be assembled as well as on the locus of its neutral position.

According to the invention, the armature is pivotally supported on a yoke plate section extending outwards of the magnet towards the armature. An edge of the armature must rest on the yoke plate section. Alternatively, the yoke plate section may extend through a slot of the armature.

According to a further embodiment of the invention, it is preferred that the armature is connected to the switch element through at least a lateral pin. A further embodiment of the invention provides a switch element including at least a bearing shell at an edge thereof which bearing shell cooperates with a bearing pin of the main plate, the switch element further including a sidewardly opening slot which is engaged by a guide pin attached to the main plate. It should be noted that the bearing pin and guide pin may be also provided on opposite sides of the switch element. The guiding slot is preferably arcuate, wherein the arc of the circle is concentrically with respect to the pivot axis. The switch element should be possibly mounted such that it is not affected from manipulation, for example using coins hanging on a thread. By means of a coin hanging on a thread, a substantial force may be exerted on the switch element. The embodiment of the invention just referred to provides a perfect mounting which is safe against manipulation.

According to the invention, the switching element is mounted through a film hinge. This reduces the expenditure for assembly and production. Furthermore, film hinges are nearly void of wear.

Alternatively, the switching element may be pivoted to the casing through a mounting pin. According to a further embodiment of the invention, the armature is mounted on a supporting plate which is laterally rigidly connected to the switching element. This embodiment is preferred for a support plate which is laterally rigidly connected to the switching element. Accordingly, the supporting plate and the switching element may be integrally be formed from plastic material. The supporting element as well can be pivoted to the casing through a film hinge.

According to the invention, the yoke provided for the magnet is L-shaped and one leg thereof may include a receiving slot for the magnet core to be secured in the receiving slot. This provides for simply assembling together the magnet core, the magnet and the yoke. The core may include a pair of adjacent core plates which are bent sidewardly and rearward-ly at the front face of the magnet adjacent the armature to form the yoke sections coacting with the lateral projections of the armature.

The yoke element may be further used to provide for fixing the magnet in the casing. To this end the outwardly extending leg of the yoke element is received like a shoe in a fixing member. The outward leg of the yoke element can be further guided in a holding slot of a fixing member and can be secured therein by locking means.

The foregoing and other objects, features and advantages of the present invention will become apparent in the light of the following detailed description of an exemplary embodiment thereof as illustrated in the accompanying drawings.

DESCRIPTION OF THE PREFERRED EMBODIMENTS

Figure 1:
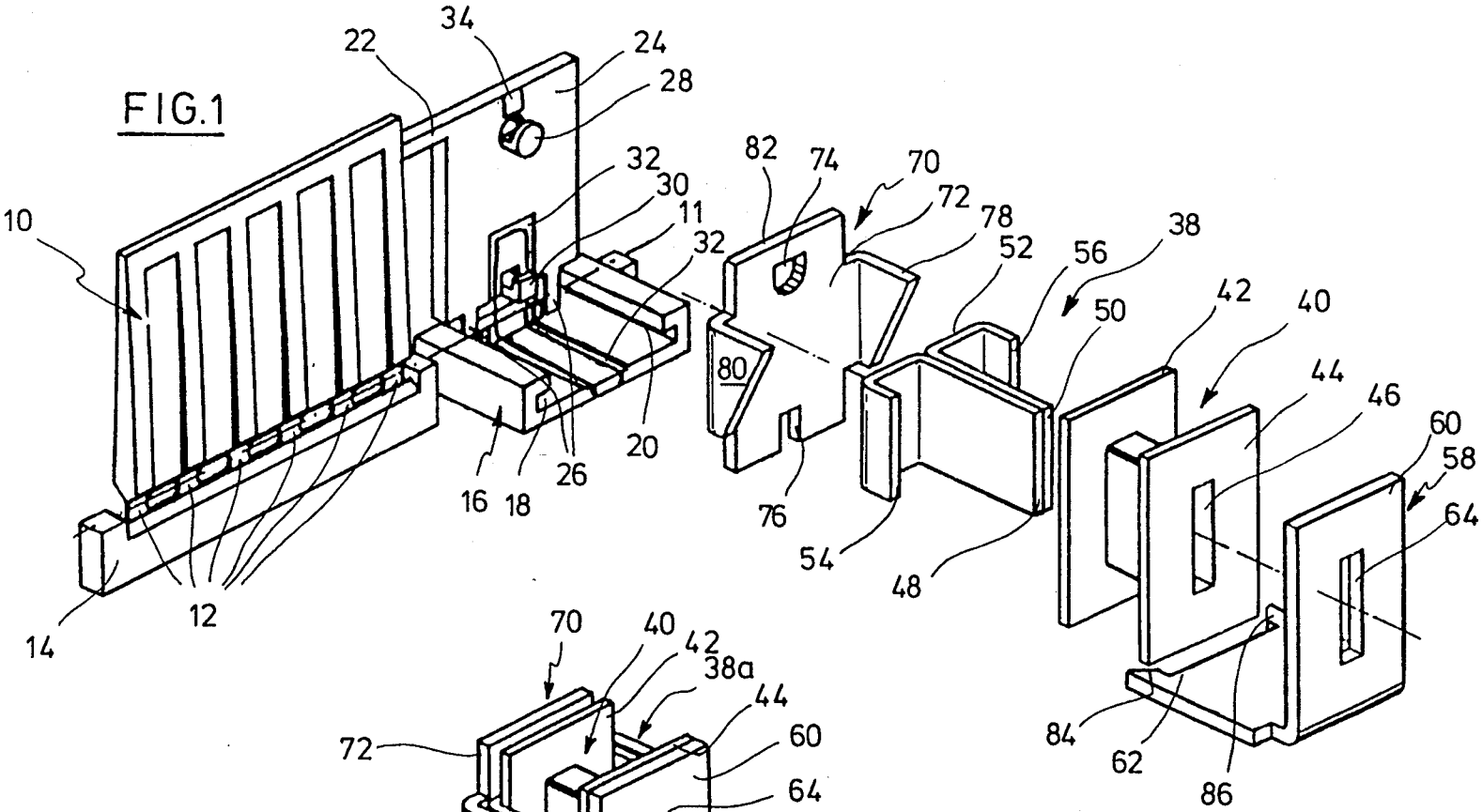
FIG. 1 is an exploded view of a first embodiment of a coin switch according to the invention.
Figure 2:
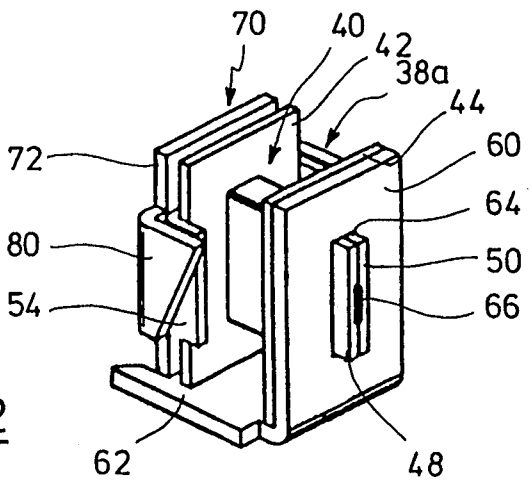
FIG. 2 is a perspective view of the magnet and the armature for the switch of FIG. 1.
Figure 3:
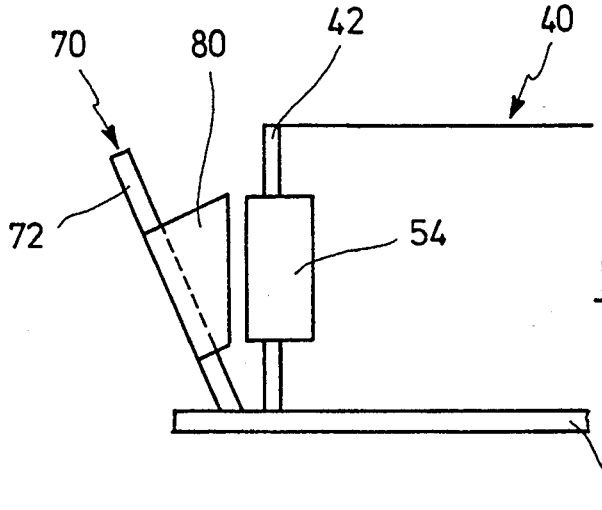
FIG. 3 is a diagram showing the cooperation of the armature and the magnet in a side view.

The embodiment shown in FIGS. 1 to 3 includes a switching element 10 which is made of plastic material and is linked to a member 14 of plastic material through distantly arranged film hinge sections 12 which are formed by perforation for example. The member 14 and a shoe-shaped support 16 are integrally formed, wherein the support 16 is C-shaped in cross-section having grooves 18 and 20. The switching element 10 is fur-ther connected to a supporting plate 24 through a rigid member 22. The supporting plate 24 is connected to the support 16 through film hinge sections. Thus the parts 10, 12, 14, 22 and 24 define a unitary structure, i.e. a unit.

Hook-shaped noses 28, 30 are provided on the supporting plate 24 in a distance from each other. A wire spring 32 located on the support 16 urges the supporting plate 24 into a position away from the support 16. Above the nose 28 there is a nose 34.

The magnet means shown in FIG. 1 in an exploded view comprises a coil 40 having front sided flanges 42, 44. The cross-section is rectangular corresponding to a rectangular passage 46. A pair of magnet core plates 48, 50 which can be inserted through the passage 46 are bent-off two times around right angles to define portions 52 and yoke portions 54, 56. A L-shaped yoke element 58 includes a leg 60 adjacent the flange 44. A second leg 62 extends along the lower side of the coil 40. The leg 60 includes a rectangular slot 64.

The magnetic means 38*a* assembled is shown in FIG. 2. The leg 60 is positioned to hold the flange 44, and the rearward ends of the core plates 48, 50 extend through the slot 64 and can be bent apart as indicated at 66 to be fixed in the slot 64.

An armature 70 includes an armature plate 72 having a semi-circular bore 74 in the upper portion and a rectangular recess 76 in the lower portion. Ear-like yoke sections 78, 80 extend from the plate by being bent rearwardly. The armature plate 72 is held by the hook-shaped noses 28, 30, wherein the upper edge 82 of the plate 72 is locked by the nose 34 in the supporting plate 24. The armature plate 72 rests on the leg 62 by gravitational force.

The leg 62 is inserted into the grooves 18, 20 along its outer edges, wherein projections 84, 86 extend through corresponding openings in the support 16 to be fixed therein by being bent. Accordingly, the magnetic means 38*a* is secured to the support 16. The wire spring 32 urges the armature 70 into a position away from the magnet (FIG. 3). The lateral yoke sections 78, 80, however, provide for a narrow air gap with respect to the yoke sections 54, 56 such that the armature 70 is initially subjected to a high pulling force when the coil 40 is supplied with electrical energy. In pulling the armature 70, the supporting plate 24 is pivoted alike to correspondingly pivot the switching element 10 as well. The axes of the film hinges 12, 26 are coaxially located so that low energy is required to operate the switching element 10.

Figure 4:
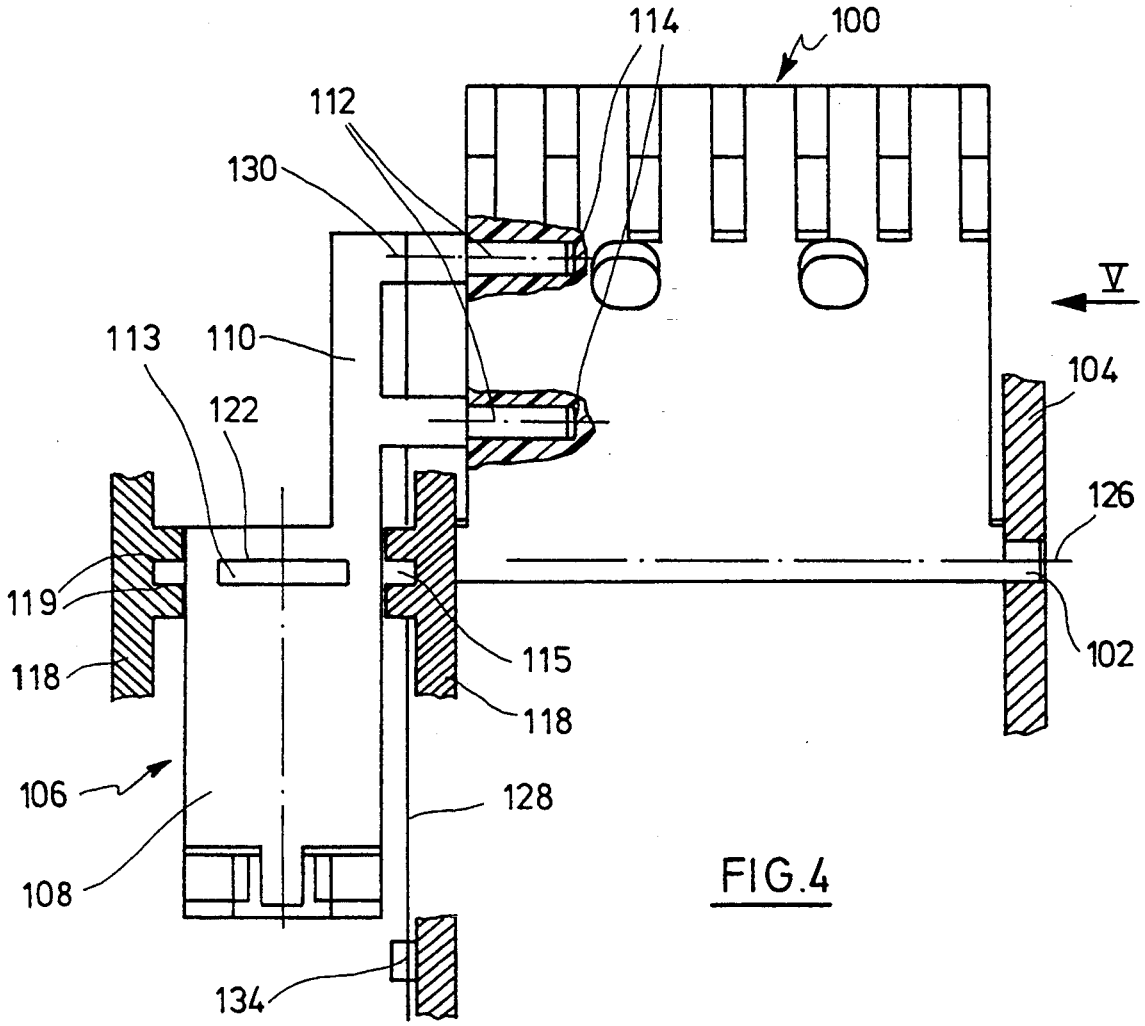
FIG. 4 is a front view of a second embodiment of a coin switch and FIG. 5 is a side view of the embodiment shown in FIG. 4 in the direction of the arrow 5.
Figure 5:
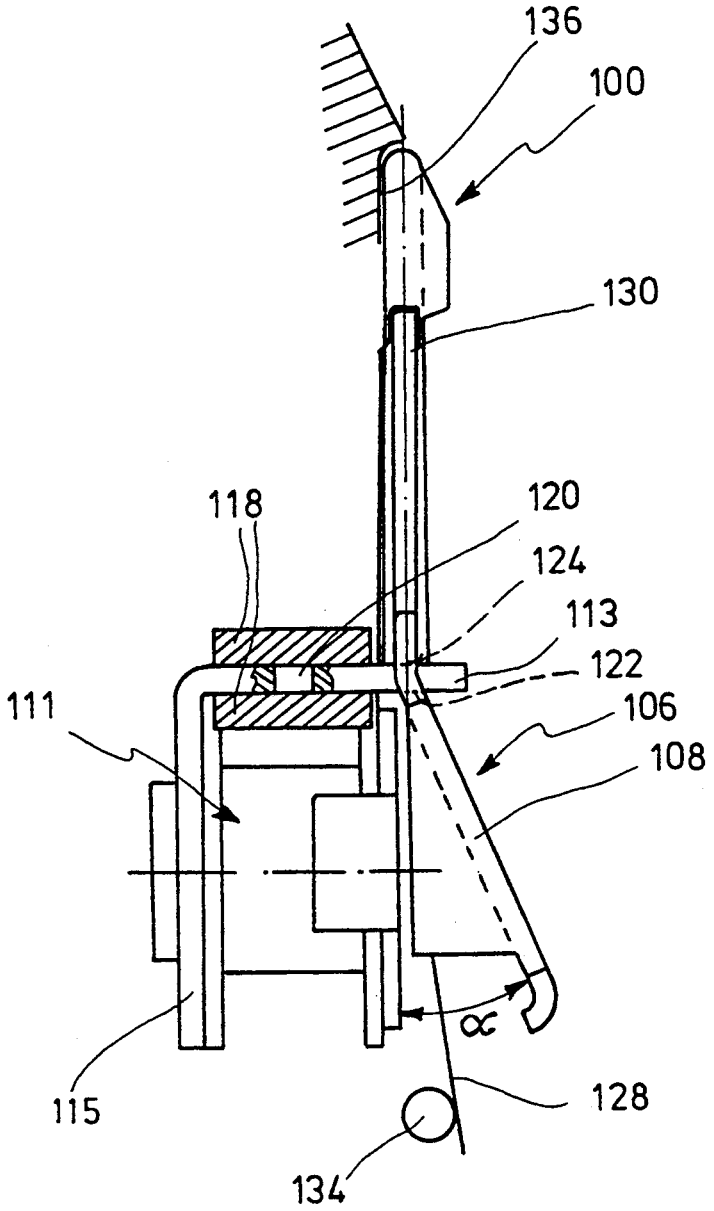

It should be noted that the coin handling device accommodating the switch shown in FIGS. 1 to 3 is not shown. The coin handling device is conventional and this is true for the embodiment shown in FIGS. 4 and 5 as well which are described below.

The switching element 100 made of plastic material is rotatably supported in a portion 104 of the casing by means of a sidewardly oriented pin 102. An armature 106 having a plate 108 similar to the structure of the armature 70 according to FIGS. 1 and 2 includes an extension 110 comprising sidewardly oriented pins 112 to be received in bores 114 of the switching element 100. A magnetic means 111 is provided which is similar in structure as the magnetic means 38*a* shown in FIG. 2. The outer leg 115 of the L-shaped yoke extends through a slot 119 of a supporting member 118 of the coin handling device to be fixed thereto by a locking means 120 not described in detail, while the other leg 114 of the yoke is positioned to be adjacent the rearward side of the magnet. The leg 113 further extends through a slot 122 of the armature 106. Thus the upper edge 124 of the slot rests on the leg 113 to define a link. The pivot axis thereof is coaxially located with respect to the pivot axis 126 of the mounting pin 102.

As may be recognized, the armature plate 108 extends under an angle $\alpha$ with respect to the switching element 100. A spring 128 which is secured to the switching element 100 at 130, and rests on a stationary abutment at 134 urges the switching element 100 into the position shown in FIG. 5 to contact a stop 136 provided on the casing. When energy is supplied to the magnet 111, the switching element 100 pivots clockwise. With respect to the pulling action of the magnetic means 111 it is referred to the description of the embodiment shown in FIGS. 1 to 3.

By proper designing the pivoting angle of the switching element, the length thereof, the orientation in the neutral position and so on, the novel switching element may be easily fit to a sorting device, for example. The coin switch or, respectively sorting switch shown has small dimensions and requires a relatively little number of parts free of wear. The energy consumption of the magnet is low.

Figure 6:
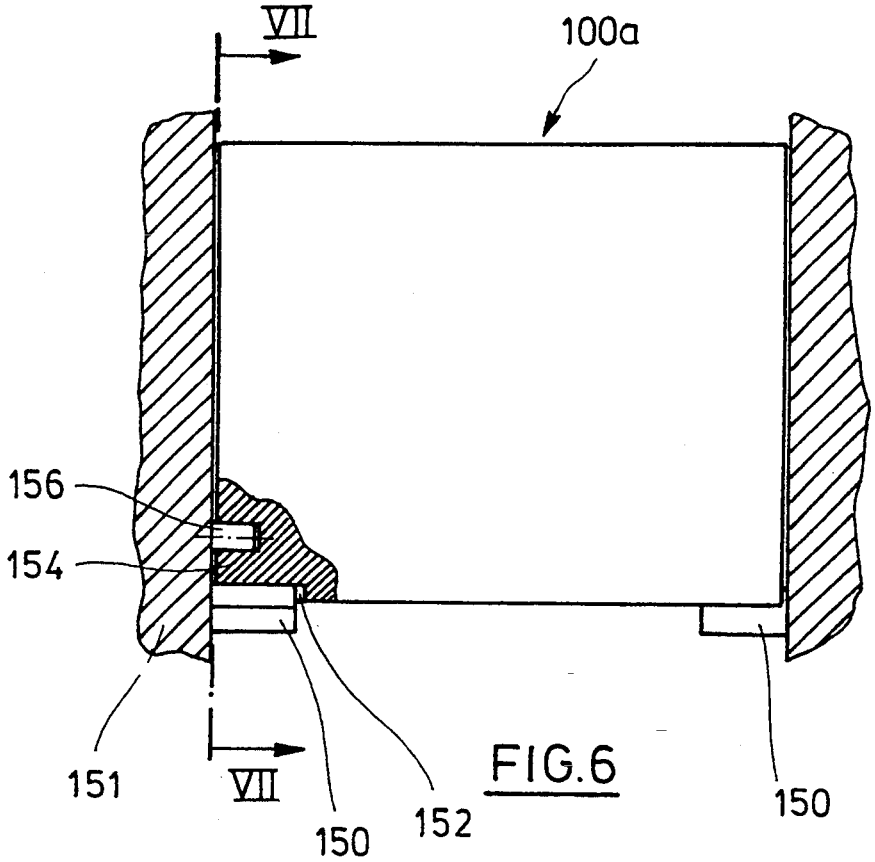
FIG. 6 is a fragmentary sectional side view of a switching element of a coin switch according to the invention.
Figure 7:
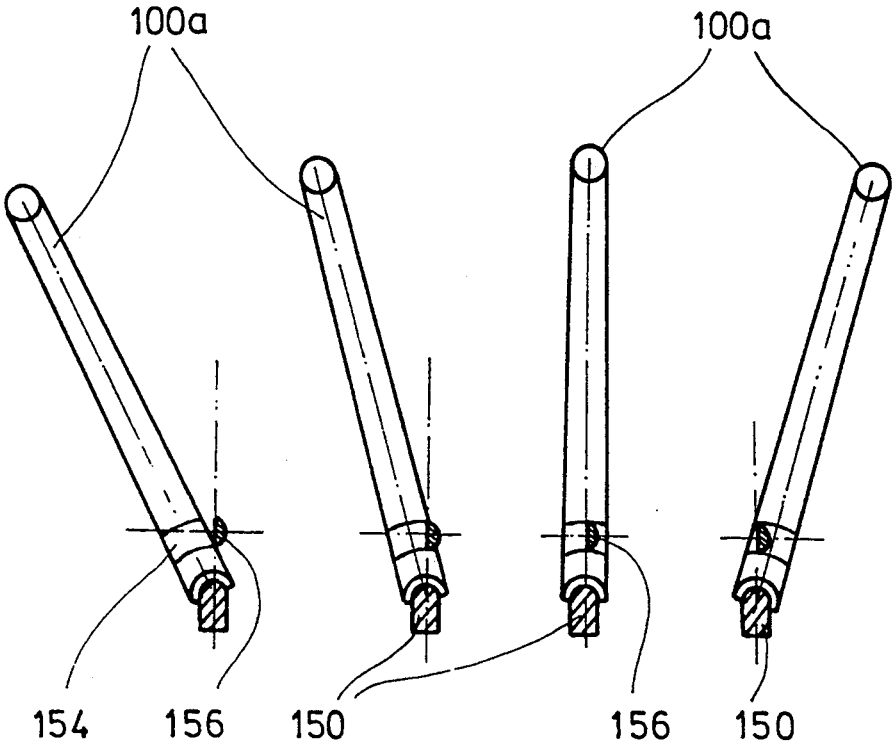
FIG. 7 is a section through FIG. 6 along the line 7—7, wherein the switch is shown in different positions.

A switching element 100*a* made of plastic material is mounted by means of bearing pins 150. The bearing pins 150 are part of the main plate 151 which is shown fragmentary. The armature portion as well is not shown in FIGS. 6 and 7. As might be recognized, the switching element 100*a* includes bearing shells 152 which are open downwards. Accordingly, the switching element 100*a* rests merely from above on the bearing pin 150.

A sidewardly open recess or slot 154 which is approximately circularly is provided on opposite sides of the switching element 100*a*. The slot coacts with a guide pin 156 which is attached to the main plate 151. The guide pin has an approximately semicircular cross-section and closely fits in the slot 154 to hold and guide the switching element 100*a* in the bearing.

I claim:

1. A coin switch for a coin handling device, comprising an electrically driven actuating magnet having a core and including a hinged armature cooperating with a switching element, said hinged armature and switching element defining a unitary structure which is rotatably supported about a common axis, characterized in that the switching element is an individual member made of plastic material, that the armature is provided with at least a lateral projection extending towards the magnet, that said core is formed of two parallel core plates lying against each other and including a yoke portion extending parallel and in a small distance with respect to said projection.

2. The coin switch of claim 1, wherein the armature and the switching element extend towards each other under an angle $\alpha$.

3. The coin switch of claim 1, wherein the armature and the switching element are located on opposite sides of the axis of rotation.

4. The coin switch of claim 1, wherein the armature and the switching element are located on the same side of the axis of rotation.

5. The coin switch of claim 1, wherein the armature pivotally rests on a yoke plate section extending along the external side of the magnet towards the armature.

6. The coin switch of claim 5, wherein the yoke plate section extends through a slot provided in the armature.

7. The coin switch of claim 1, wherein the armature is connected to the switching element through at least a sidewardly oriented pin.

8. The coin switch of claim 1, wherein the switching element is linked to a stationary member through a film hinge.

9. The coin switch of claim 1, wherein the switching element is linked to a housing portion through a bearing pin.

10. The coin switch of claim 1, wherein a bearing shell is provided at an edge of said switching element, which bearing shell coacts with a bearing pin of a main plate and wherein the switching element includes a sidewardly open guide slot in a distance from the bearing shell, which slot is engaged by a guide pin attached to the main plate.

11. The coin switch of claim 10, wherein the guide slot is circularly curved and wherein the guide pin closely fits into the guide slot in the respective pivoting position of the switching element.

12. The coin switch of claim 1, wherein the armature is secured to a supporting plate which is rigidly connected to the switch element at one side thereof.

13. The coin switch of claim 12, wherein the supporting plate is linked to the coin handling device through a second film hinge.

14. The coin switch of claim 5, wherein a L-shaped yoke element is provided, comprising a leg coacting with the front face of the magnet, which leg includes a slot for receiving a number of core plates axially extending through the magnet and receiving said yoke section, which core plates are locked in the slot.

15. The coin switch of claim 14, wherein the magnet core comprises a pair of adjacent core plates having ends facing said armature which ends are bent sidewardly and rearwardly for defining said yoke section.

16. The coin switch of claim 14, wherein the outer leg of the yoke element is received in a shoe-shaped support.

17. The coin switch of claim 16, wherein the leg includes at least a projection to be bent for fixing the leg to the support.

18. The coin switch of claim 14, wherein the outer leg of the yoke element extends through a slot provided in a holding member to be fixed therein by a snap connection.

19. The coin switch of claim 14, wherein a spring is arranged to provide a safe support for the armature rotatably supported about said yoke element.

* * * * *